US006904888B1

(12) United States Patent
Heifets

(10) Patent No.: US 6,904,888 B1
(45) Date of Patent: Jun. 14, 2005

(54) RECIPROCATING PISTON DEVICE

(76) Inventor: Nuhim Heifets, 1125¼ N. Detroit St., Los Angeles, CA (US) 90046

( * ) Notice: Subject to any disclaimer, the term of this patent is extended or adjusted under 35 U.S.C. 154(b) by 0 days.

(21) Appl. No.: 10/790,278

(22) Filed: Mar. 1, 2004

(51) Int. Cl.[7] ..... F02B 75/32
(52) U.S. Cl. ..... 123/197.1; 123/53.1; 74/40
(58) Field of Search ..... 123/53.1, 53.4, 123/197.1, 197.4; 74/40

(56) References Cited

U.S. PATENT DOCUMENTS 1,522,504 A * 1/1925 Fabian ..... 123/53.5
1,719,537 A * 7/1929 Dulche ..... 123/53.3
1,734,489 A * 11/1929 Jereb ..... 123/53.4
2,619,943 A * 12/1952 Monleone ..... 123/53.3
5,562,075 A 10/1996 Walsh
5,673,665 A 10/1997 Kim
5,934,243 A 8/1999 Kopystanski

* cited by examiner

*Primary Examiner*—Noah P. Kamen

(57) ABSTRACT

A reciprocating piston engine (or motor) includes plural reciprocating pistons operatively connected to a single intermediate oscillating shaft, and a crankshaft having a single crank pin operatively connected to the oscillating shaft, so that the crankshaft experiences one complete revolution for each back-and-forth reciprocation of the pistons. The connection between the pistons and the oscillating shaft can include a rack-pinion drive system or a link-lever drive system. The connection between the oscillating shaft and the crankshaft can include a sector gear in mesh with a toothed rack that operates a connecting rod attached to the crank pin; alternately a lever-connecting rod drive mechanism can be used between the oscillating shaft and the crankshaft.

9 Claims, 7 Drawing Sheets

SECTION A-A

SECTION C-C

SECTION D-D

SECTION B-B

SECTION E-E

SECTION F-F

SECTION H-H

SECTION G-G

SECTION I-I

SECTION J-J

RECIPROCATING PISTON DEVICE

Disclosure documents 507456 and 523965 respectively preceded Applicant's patent application as follows:

FIELD OF THE INVENTION

This invention relates to reciprocating piston motors, e.g., internal combustion engines, steam engines and fluid motors (air or hydraulic). A principal use of the invention is in internal combustion engines.

BACKGROUND OF THE INVENTION

In many conventional four cycle engines each piston is individually connected to the drive shaft by means of a connecting rod and crank arm. The drive shaft comprises a crankshaft having one crank pin and counterweight for each piston.

The conventional crankshaft is relatively long and heavy, especially in the case of eight cylinder in-line engines. In order to balance the internal engine forces, several relatively heavy counterweights are required (one for each piston). The crankshaft cost becomes a major factor. Also, the crankshaft bearings have to be relatively heavy and numerous to absorb momentary unbalanced forces.

Another problem with conventional piston engines is that each piston lacks lateral support. The conventional connecting rod obliquely transmits the axial force component of the piston without restraining the piston against lateral movement, such that the piston exerts a considerable lateral force on the cylinder wall. The piston has to be relatively long to distribute the lateral forces and prevent excessive wear on the piston or cylinder wall.

The long piston requirement and crankshaft design requirements tend to unduly increase the overall size and weight of the engine, especially with engines having a large number of cylinders.

Some engine designs have been proposed to overcome problems associated with conventional piston engines. In one such engine design the pistons are aligned in pairs. Two opposed in-line pistons are rigidly connected together for conjoint movement by a toothed rack, so that one piston moves toward the top dead center position while the other piston moves away from the dead center position and vice versa. The pistons can be relatively short because the forces are largely axial (not lateral).

A toothed gear in mesh with the tooth rack oscillates rotationally to provide the engine output force. Special clutches and counter shafts are required to translate gear oscillational motion into one way rotation of the output shaft.

The described engine designs overcome some problems associated with conventional engines. However, such designs have their own problems, associated with the require-ment for an increased number of shafts, and gears. In most cases slip clutches are required to translate gear oscillation into one way rotation of the output shaft. Slip clutch arrangements are shown in U.S. Pat. No. 5,673,665 (Kim), and U.S. Pat. No. 5,562,075 (Walsh)

U.S. Pat. No. 5,673,665, issued to Min-Tac-Kim on Oct. 7, 1997 shows an engine that includes two opposed in-line piston-cylinder assemblies having a piston rod rigidly connecting the two pistons, whereby one piston moves toward the top dead center position while the other piston moves away from the top dead center position, and vice versa Rack gear teeth on the piston rod are in mesh with gear teeth on two counter shafts extending transverse to the motion path of the piston rod. One way clutches on the counter shafts intermittently transmit drive forces to aligned shafts that have geared connections to an output shaft located midway between the aligned shafts.

As the piston rod moves back and forth the one-way clutches are alternately in the drive mode and slip mode, so that the output shaft is driven in one direction.

The drive system described in U.S. Pat. No. 5,673,665 is relatively complex. Five separate shafts are required to produce rotary movement of the output shaft.

U.S. Pat. No. 5,562,075, issued to N. Walsh on Oct. 8, 1996, shows an engine whereon two oppositely-moving pistons are linked to a rotary shaft that rocks back and forth in synchronism with the pistons. The shaft has ratchet connections with two separate bevel gears that are in mesh with a third output gear. The bevel gears are alternately in the drive mode and slip mode, so that the output gear is driven in one direction. In many respects, the engine of U.S. Pat. No. 5,562,075 is similar to the engines of U.S. Pat. No. 5,673,665. In both cases the drive force is directed through slip clutches.

U.S. Pat. No. 5,934,243, issued to G. Kopystanski on Aug. 10, 1999, shows an engine wherein each piston has a piston rod that has one toothed rack in mesh with a power drive gear and a second toothed rack in mesh with an idler gear. Apparently each piston drives the associated power drive gear on the downstroke and the idler gear on the upstroke. A system of timing gears is apparently used to provide power to an output shaft 78 when the piston is on the upstroke. Slip clutches are used to achieve uni-directional movement of the output shaft. The drive system is quite complex. Several shafts 38, 42, 14, and 78 are required.

SUMMARY OF THE PRESENT INVENTION

The present invention relates to a reciprocating piston motor (engine) that inherently has a decreased volume and weight for a given power output. A resultant advantage is a lower cost and greater usefulness (due to the ability to fit into smaller size engine compartments).

The motor (engine) of the present engine uses shorter pistons and less complicated crankshafts, while having a desirable self-balancing character that minimize internal loads.

In illustrative embodiment of the invention comprises an engine wherein the pistons are arranged in pairs, so that two pistons are aligned on a common axis for conjoint reciprocating movement. All pistons are kinematically connected to a single intermediate shaft, which oscillates rotationally in response to back and forth movement of the pistons.

The intermediate shaft is kinematically connected to a crankshaft, that has a single crankshaft, that has a single crank pin offset from the crankshaft axis. Crank pin offset distance is designed to be equal to the piston stroke travel distance, so that the crankshaft experiences precisely one revolution for each complete reciprocation of the piston. The entire piston force is directed through the single crank pin, so that the crankshaft can be relatively short. Crankshaft bearings can be relatively light and low cost.

The engine (motor) of the present invention is advantageous in that forces on the pistons are primarily axial (not lateral), such that each piston can be relatively short. Also, the crankshaft design is greatly simplified, in that the crankshaft has only a single crank pin, irrespective of the number of pistons in the engine. The crankshaft can be relatively short and light weight, with consequent reduction in overall cost of the engine. Due to a combination of advantageous factors the engine can have a reduced size for a given power output. Overall cost of the engine can be relatively low.

Further features of the invention will be apparent from the attached drawings and description of illustrative embodiments of the invention.

BRIEF DESCRIPTION OF THE DRAWINGS

FIG. 6 is taken in the same direction as FIG. 2

DETAILED DESCRIPTION OF A PREFERRED EMBODIMENT OF THE INVENTION

Referring to FIGS. 1 through 5, there is shown a four stroke cycle engine having four pistons, and constructed according to the present invention. The engine (or motor) includes a case 55 that supports two cylinder heads 57 containing the usual intake and exhaust valves, together with the associated cam shafts and timing gear employed in four stroke cycle engines.

This particular engine has four cylinders and associated pistons 31A and 31B that are grouped in two in-line pairs. The two aligned pistons 31A are rigidly connected together by a bar (or rod) 39A and the two aligned pistons 31B are rigidly connected together by a bar (or rod) 39B. Each bar 39A or 39B has teeth 41A or 41B extending therealong, whereby the respective bar constitutes a toothed rack.

Figure 2:
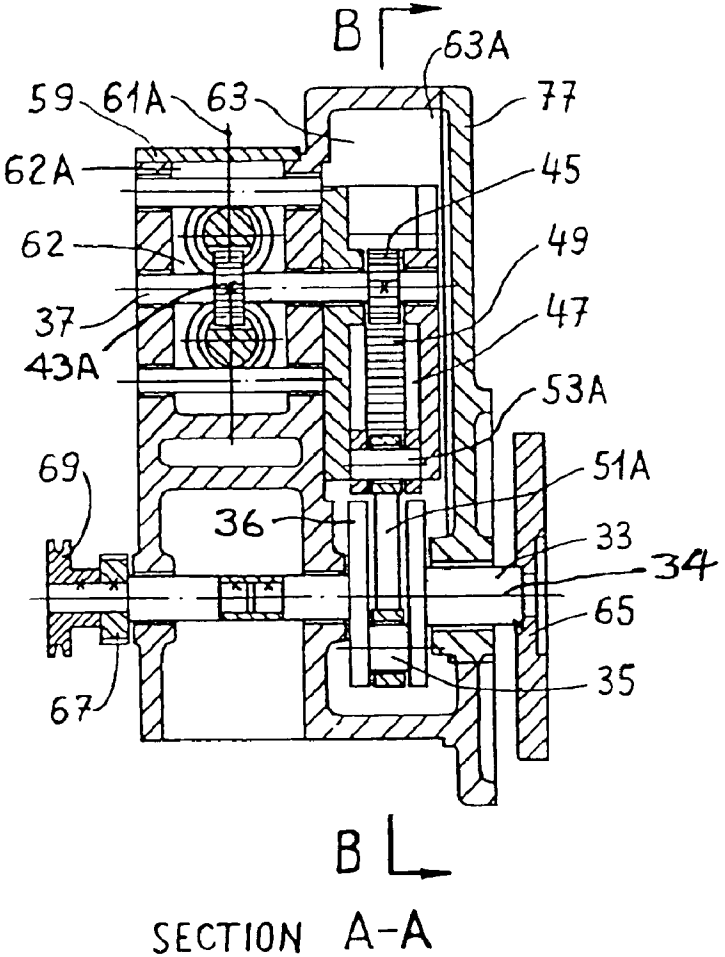
FIG. 2 is a sectional view taken on line A—A in FIG. 1.
Figure 3:
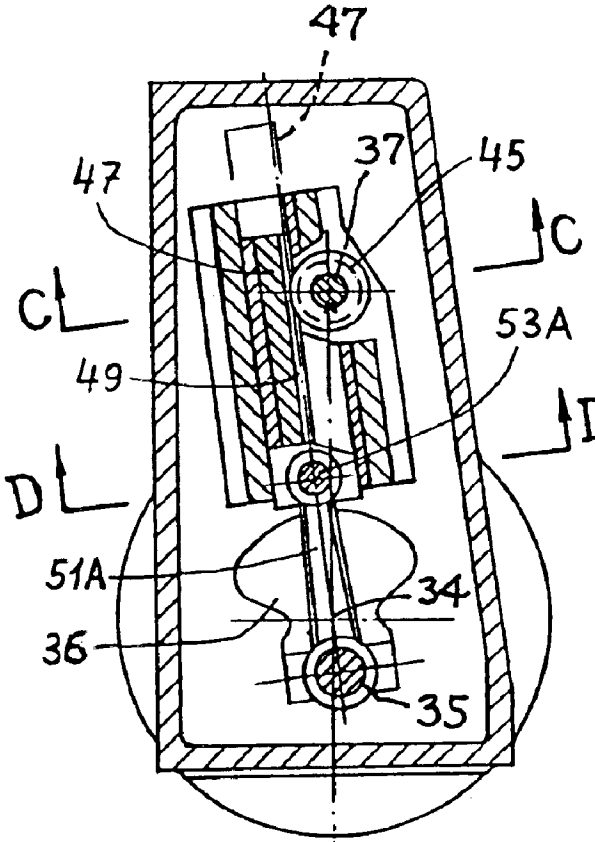
FIG. 3 is a sectional view taken on line B—B in FIG. 2.

A single pinion gear 43A is in simultaneous mesh with both toothed racks 41A and 41B, so that each rack can serve as a driver for the pinion gear at different times in the engine cycle. Pinion gear 43A is carried on an intermediate shaft 37 that extends rightwardly into a case section 63, as shown in FIG. 2 shaft 37 carries a sector gear 45 that is in mesh with teeth 49 formed on an elongated slide block 47. Block 47 forms a second toothed rack. A suitable housing structure within case section 63 guides rack 47 for slidable up or down movement. As shown in FIG. 3, rack 47 is at the downward limit of its stroke. The dashed lines in FIG. 3 indicate the upward limiting position for rack 47.

A crankshaft 33 is rotatably supported in case 55 for continuous one-way rotation around a shaft axis 34. At the right end, the crankshaft carries a flywheel 65. At its left end, the crankshaft carries a gear 67 that can be used to drive the usual cam shafts or similar valve timing gear, and other accessories. A pulley 69 on the extreme left end of the crankshaft can be used to start the engine (using a starter motor). Crank-shaft 33 constitutes the output drive shaft for the engine. The engine load is connected to shaft 33, e.g., through flywheel 65.

Figure 1:
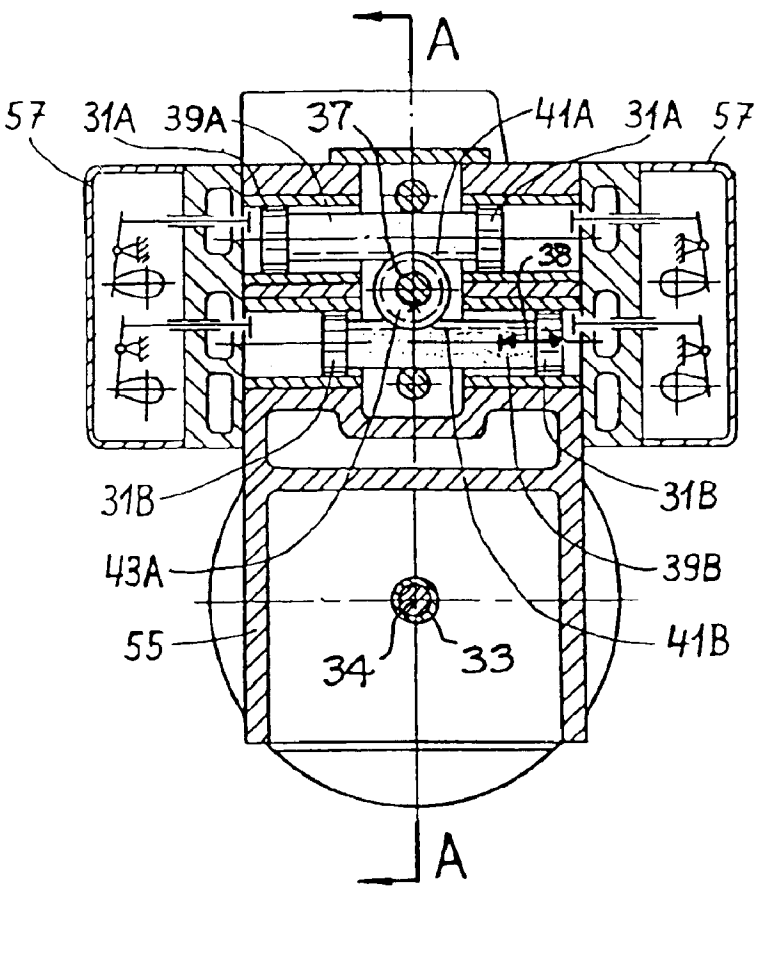
FIG. 1 is a sectional view taken through an engine (or motor) embodiment of the Invention.

Crankshaft 33 is provided with a single crank pin 35 whose axis is offset from shaft axis 34 by a predetermined distance, such that crankshaft 33 experiences one complete revolution for each complete reciprocation of the pistons 31A and 31B. The predetermined pin offset distance is designed to be approximately equal to the stroke travel distance of each piston, so that during piston motion in one direction shaft 33 rotates one half revolution; during return movement of the piston, crankshaft 33 rotates another half revolution. In FIG. 1, numeral 38 denotes the stroke travel distance of each piston, i.e., the distance from the top dead center position to the bottom dead center position.

The mechanism for driving crankshaft 37 consists of a single connecting rod 51A trained between rack 47 and crank pin 35 on shaft 33. Rack 47 carries a transverse pin 53A that serves as a pivotal connection between the rack and connecting rod 51

During operation of the engine the four pistons 31A and 31B reciprocate through stroke distance 38, such that gear 43 has a rotary oscillatory movement in the clockwise and counterclockwise directions. Intermediate shaft 37 oscillates back and forth under the impetus of gear 43, a primary transmission mechanism. Shaft 37 imparts an oscillational rotation to sector gear 45, a secondary transmission mechanism, that drives rack 47 up and down between the full line position and the dash line position (FIG. 3). Rack 47 acts on connecting rod 51A to produce continuous one way rotation of crankshaft 33.

As previously noted, crankshaft 33 experiences one complete revolution for each cyclic travel of the pistons (i.e., movement from the top dead center position to the bottom dead center position and back to the top dead center position). The desired relationship is achieved by making the offset distance of crack pin 35 approximately equal to the piston travel distance 38. If the diameter of gear 45 is slightly less than the gear 43A, then the crank pin offset distance is increased slightly. If the gear 43A diameter is slightly greater than the gear 43A diameter then the crank pin offset distance is decreased accordingly. The dimensional relationships are incorporated in the engine design.

In order to provide a desirable momentum for crankshaft rotation at the twelve o'clock and six o'clock positions, the crankshaft is provided with a counterweight 36 spaced diametrically away from crank pin 35 (i.e., on a diametrical line passing through the crank pin axis.

As shown in FIG. 1, the pistons 31A and 31B are adequately guided so that lateral loads between the cylinder walls and piston side surfaces are greatly minimized. This is due to the way that piston movement is transferred to pinion gear 43A, and also to the fact that each piston acts as a guide for the other piston. Minimized loadings on the piston side surfaces enables the pistons to be shorter than pistons used in conventional engines. As a result, the size of the engine in the direction of piston motor can be somewhat reduced.

The engine (motor) shown in FIGS. 1 through 5 has four pistons, but only one-crank-connecting rod assembly. This is due to the fact that the entire piston force is directed through a single intermediate shaft 37. Oscillatory motion of shaft 37 is converted to continuous one way rotation of crankshaft 33 by means of a single sector gear 45, toothed rack 47 and connecting rod 51A. The crankshaft design is greatly simplified, due to the fact that only one crank pin 35 is required, irrespective of the number of pistons used in the engine.

Figure 6:
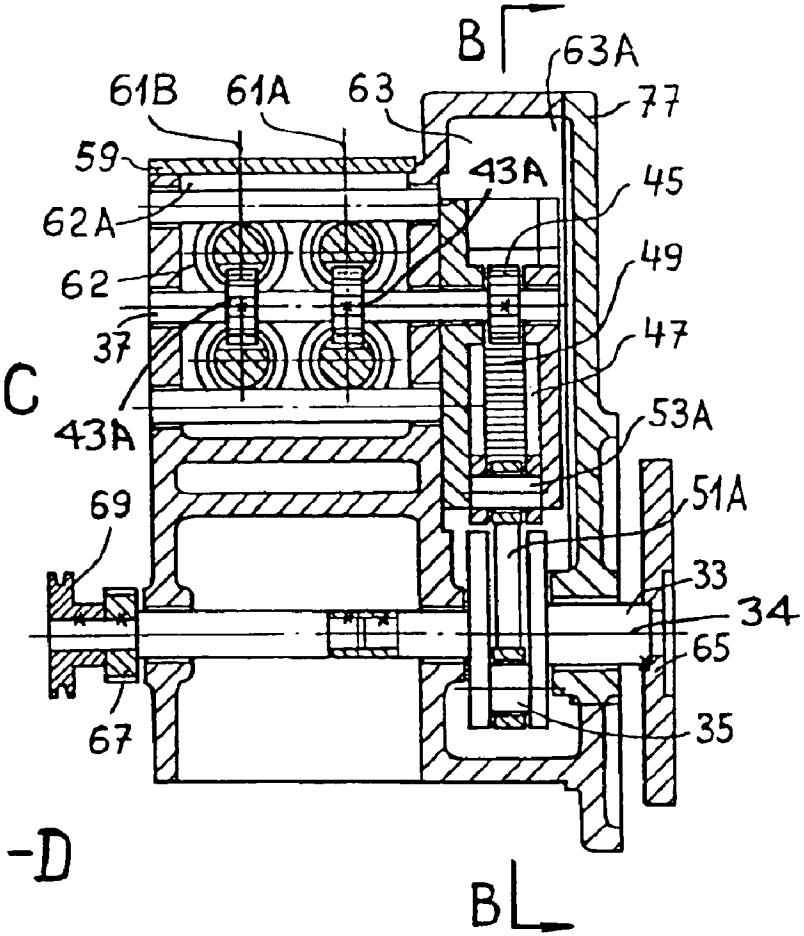
FIG. 6 is a sectional view taken through another engine (or motor) embodying the Invention.
Figure 4:
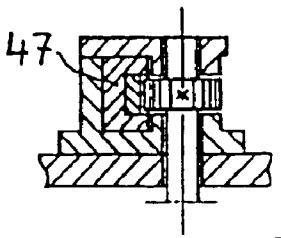
FIG. 4 is a fragmentary sectional view taken on line C—C in FIG. 3
Figure 5:
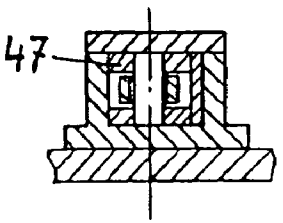
FIG. 5 is a fragmentary sectional view taken on line D—D in FIG. 3

FIG. 6 shows an engine (motor) that is basically the same as the engine shown in FIG. 2, except that the FIG. 6 engine has eight pistons instead of four pistons. In the FIG. 6 engine there are four pairs of in-line pistons arranged in a square pattern. Power is transferred to intermediate shaft 37 by two separate pinion gears 43A, 43A .

Even though the FIG. 6 engine has eight pistons (rather than four), only one connecting rod 51 A crank pin 35 assembly is required for converting the oscillatory motion of shaft 37 into continuous one way rotation of crankshaft 33. A relatively low cost crankshaft can be used in the FIG. 6 engine. In FIG. 6, line B—B indicates a cross sectional view sight line that would produce a sectional view similar to that depicted in FIG. 3.

The FIG. 6 engine is in major respects similar to the FIG. 1 engine except for the piston complement (eight pistons versus four pistons).

Figure 8:
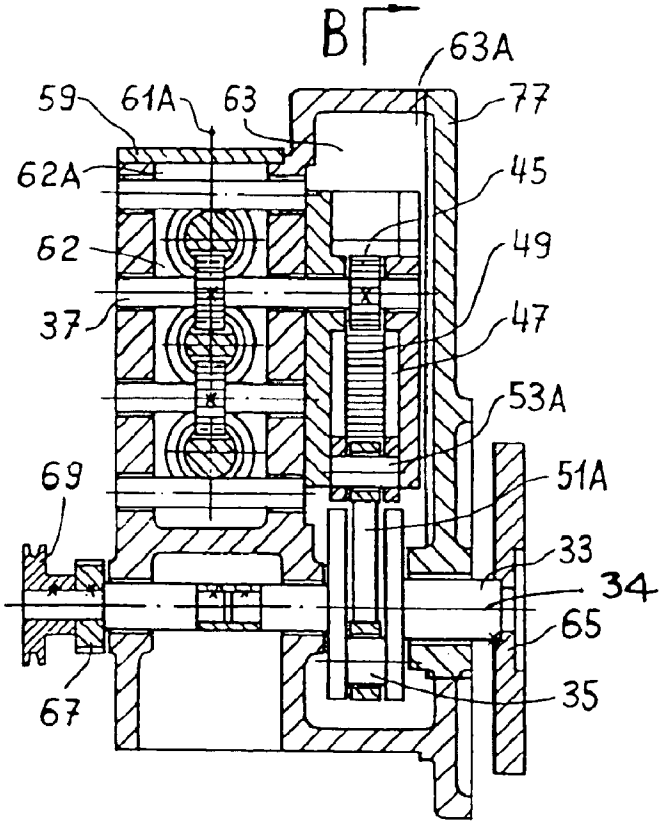
FIG. 8 is a transverse sectional view taken on line E—E in FIG. 7
Figure 7:
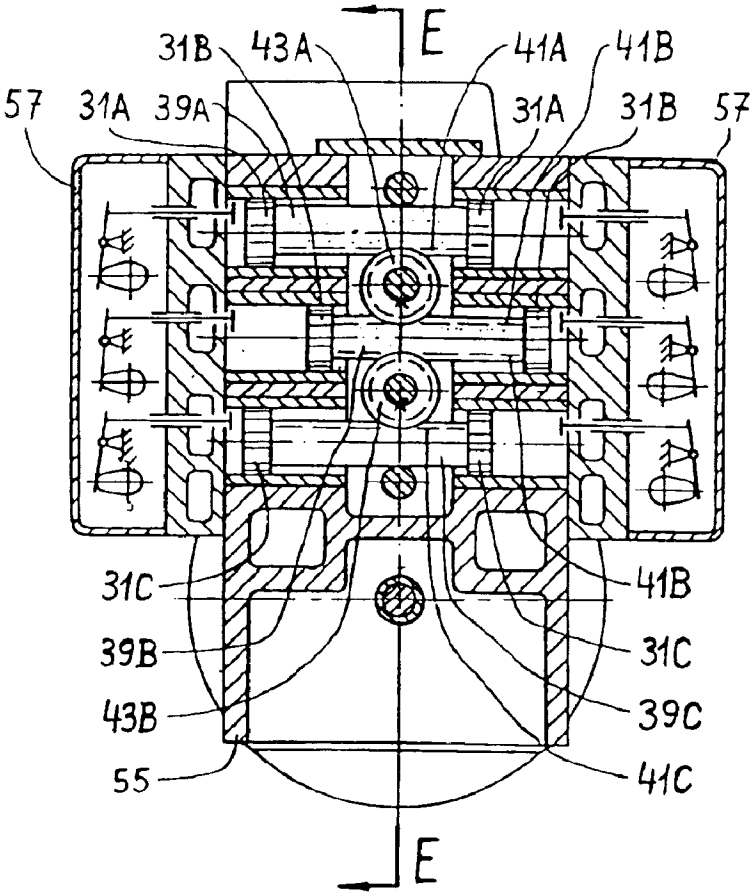
FIG. 7 is a sectional view taken through a third embodiment of the invention.
Figure 10:
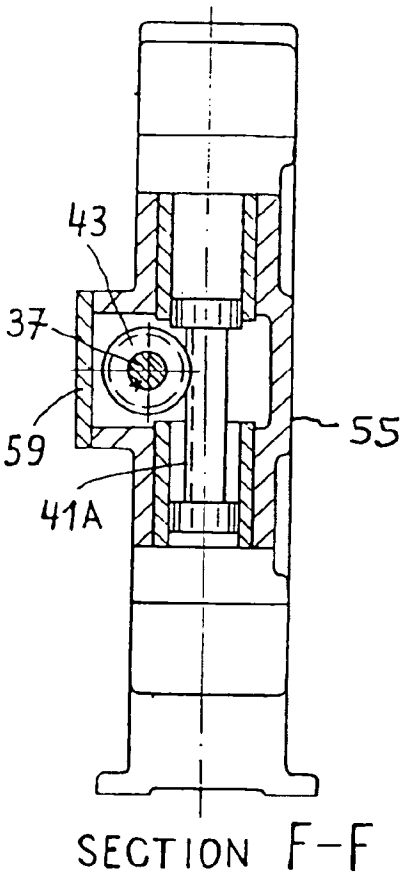
FIG. 10 is a transverse sectional view taken on line F—F in FIG. 9.

FIGS. 7 and 8 show an engine (motor) that is basically the same as the FIG. 1 engine, except that the FIG. 7 engine has six pistons, rather than four. The six pistons, rather than four. The six pistons are arranged in three pairs, each pair comprising two in-line pistons. As shown in FIG. 8, all six pistons are located in a common vertical plane designated by numeral 61 A.

In the FIG. 7 engine, an auxiliary shaft 37A is used to transfer oscillatory motion from the two lowermost pistons to intermediate shaft 37. Shaft 37A carries a pinion gear 43B that is in simultaneous mesh with toothed rack 39C and toothed racked 39B. Pinion gear serves at times as a drive gear for toothed rack 39C and at other times as a drive gear for toothed rack 39B. Net power output is directed into the single oscillating shaft 37.

Shaft 37 is kinematically connected to crankshaft 33 by the same connecting means 45, 47, 51A that is used in the FIG. 1 engine. In FIG. 8, line B—B is a sight line that would produce a sectional view generally similar to the sectional view depicted in FIG. 3. The FIG. 8 engine is in most respects similar to the engines depicted in FIGS. 1 and 6, except for the piston complement.

FIGS. 9 through 12 illustrate an in-line engine wherein the pistons are arranged in a single row. The FIG. 9 engine would typically be more powerful engine useful as a stationary or marine engine, e.g., in diesel submarines, diesel locomotives or buses. The FIG. 9 engine has a relatively low width, low volume and low weight, with a small engine compartment requirement. All pistons are arranged vertically, with the piston axes located in one common vertical plane parallel to the axis of intermediate shaft 37.

Figure 9:
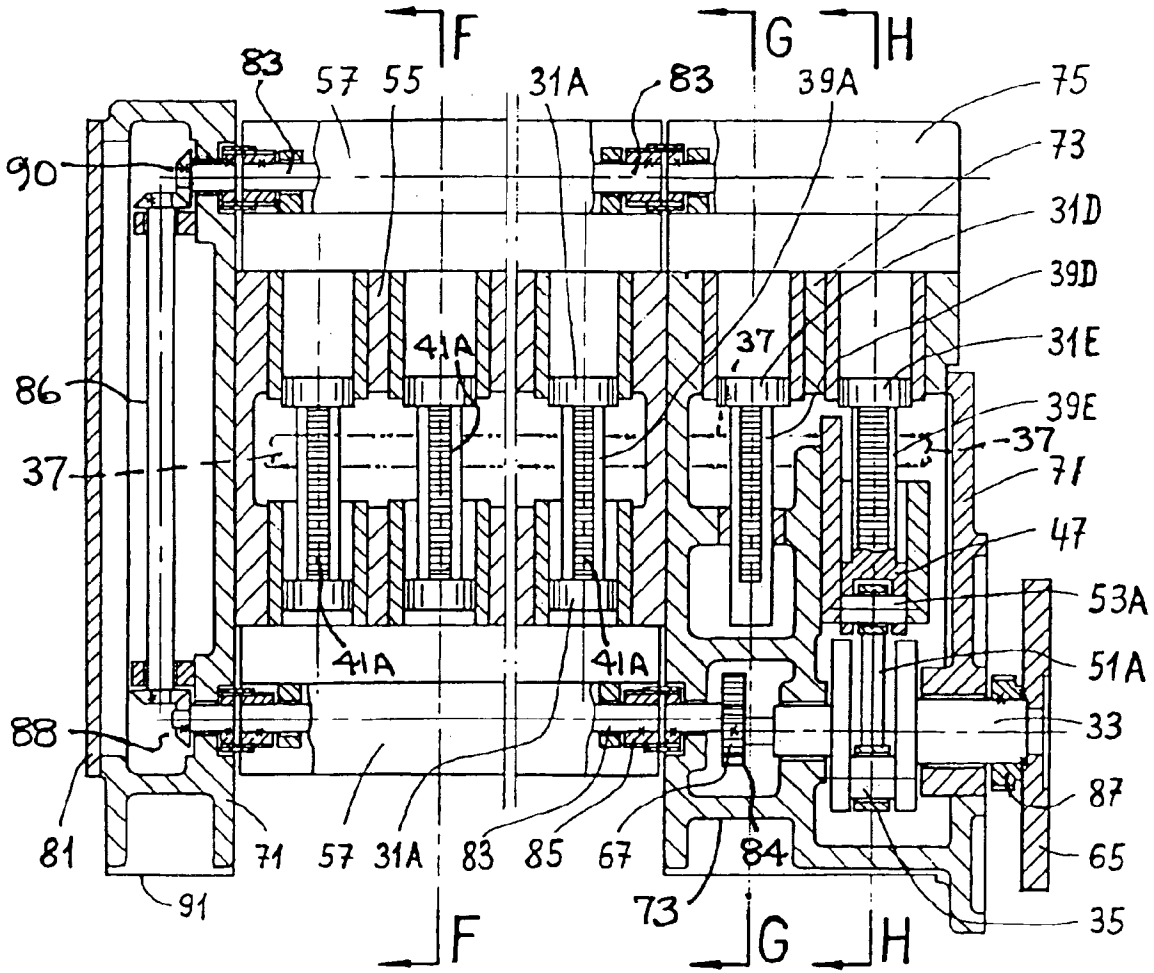
FIG. 9 is a sectional view taken through another engine embodying the invention.
Figure 13:
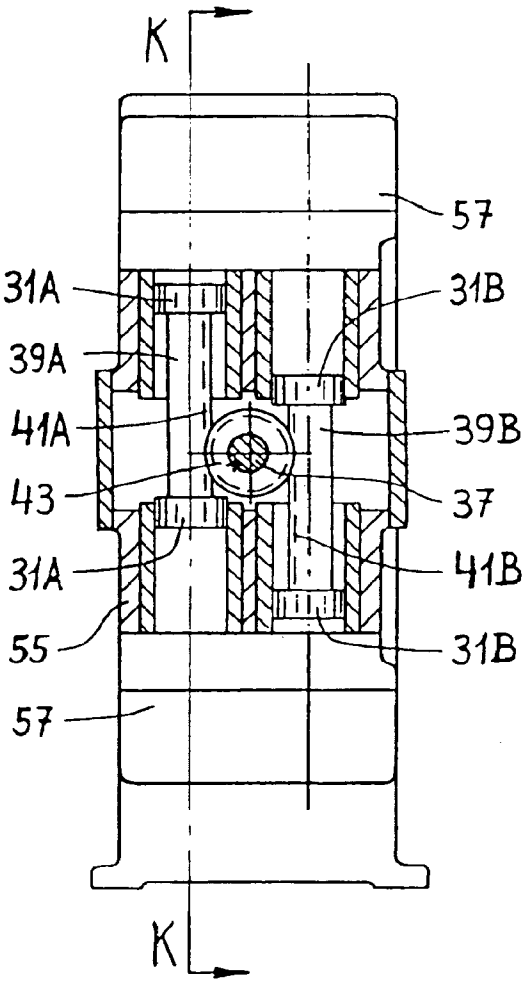
FIG. 13 is a transverse sectional view taken through a further engine embodying the invention.

Shaft 37 is not visible in FIG. 9. However, the shaft is shown in phantom in FIG. 9 to clarify the fact that shaft 37 spans the entire compliment of pistons.

Essentially, the entire piston power output is directed through shaft 37. A pinion gear 43 is located on shaft 37 in registry with each toothed rack 41A. Additionally, pinion gear 45 is located on shaft 37 in registry with toothed rack 41 that connects with piston 31 E. Consequently, all of the power pistons in the engine are kinematically connected to shaft 37. Essentially, he entire piston power output is directed into shaft 37.

Figure 12:
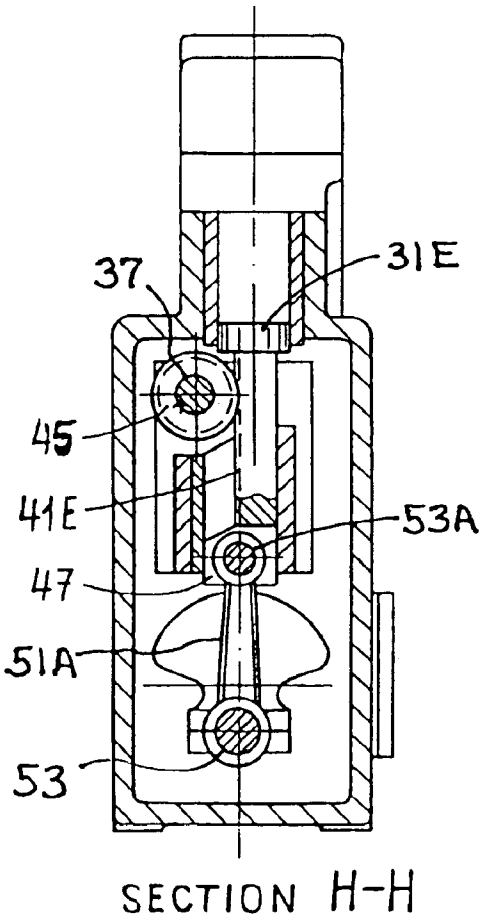
FIG. 12 is a transverse sectional view taken on line H—H in FIG. 9
Figure 11:
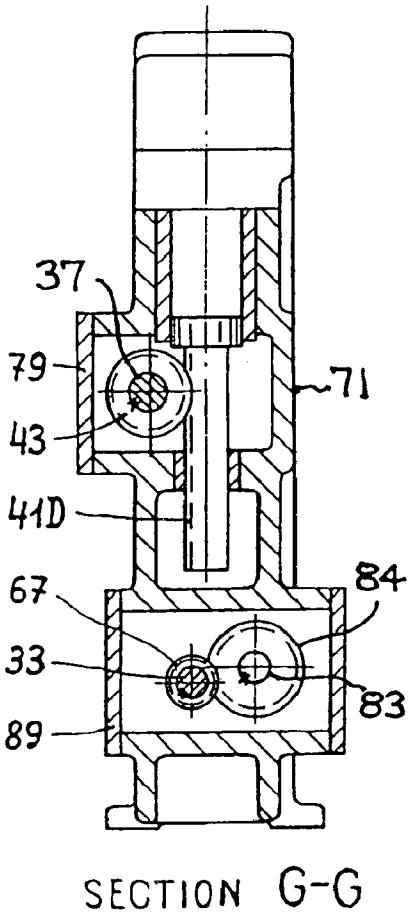
FIG. 11 is a transverse sectional view taken on line G—G in FIG. 9.

FIG. 12 shows the connecting means for kinematically connecting the oscillating shaft 37 to the engine output crankshaft 33. Rack 47 is formed, in part, by the toothed rod 41E, such that oscillatory motion of shaft 45 is transferred to connecting rod 51A via pivot pin 53A. Connecting rod 51 has a swivel connection with crank pin 53, whereby the entire power output of the engine is delivered to crankshaft 33. As with the other embodiments of the invention, a low cost crankshaft, having only one crank-arm (pin) can be used. The pistons can be relatively short pistons, i.e., shorter than the pistons used in conventional engines wherein the pistons have pivotal connections with individual connecting rods.

The engine housing can be constructed in various ways. As shown in FIGS. 9 through 12, the engine housing includes a casing 55 containing six of the eight pistons, and a second casing 73 containing the remaining two pistons. A cover 71 provides access to casing 71 provides access to casing 73 (for assembly purposes). Valve housings 57, 57, 57 are provided for the necessary intake valves, exhaust valves and cam shafts.

FIG. 9 shows a mechanism for powering the various valve-operating camshafts. Gear 67 on crankshaft 33 is in mesh with a larger gear 84 carried on a first camshaft 83. The camshaft is preferably sectionalized for assembly purposes. Camshaft 83 has a bevel gear connection 88 with a vertical shaft 86 that has a second (upper) crankshaft 83. The camshafts are driven synchronously to operate the engine intake and exhaust valves in conventional fashion.

The engine depicted in FIGS. 9 through 12 operates in a generally similar fashion to the earlier-described engines. Each piston is connected to a single oscillating shaft 37 via a first connecting means that includes individual toothed racks for the individual pistons and individual pinion gears carried by shaft 37 in mesh with the respective toothed racks. Shaft 37 is kinematically connected to crankshaft 33 by a single connection means that includes a single gear 45, toothed rack 47 and connecting rod 51A.

Figure 15:
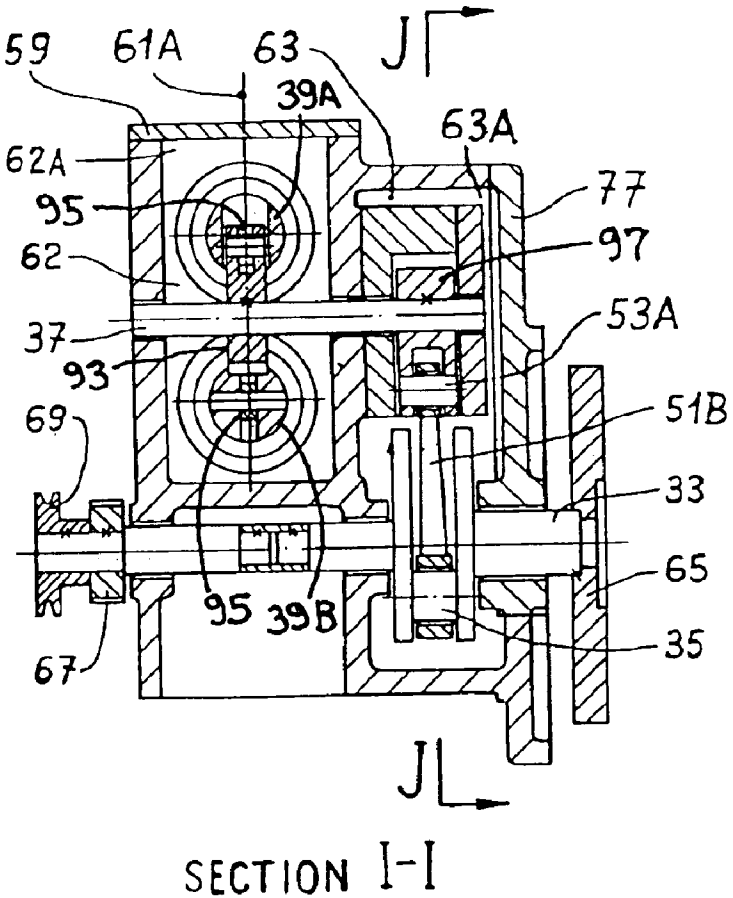
FIG. 15 is a sectional view taken on line I—I in FIG. 14.
Figure 14:
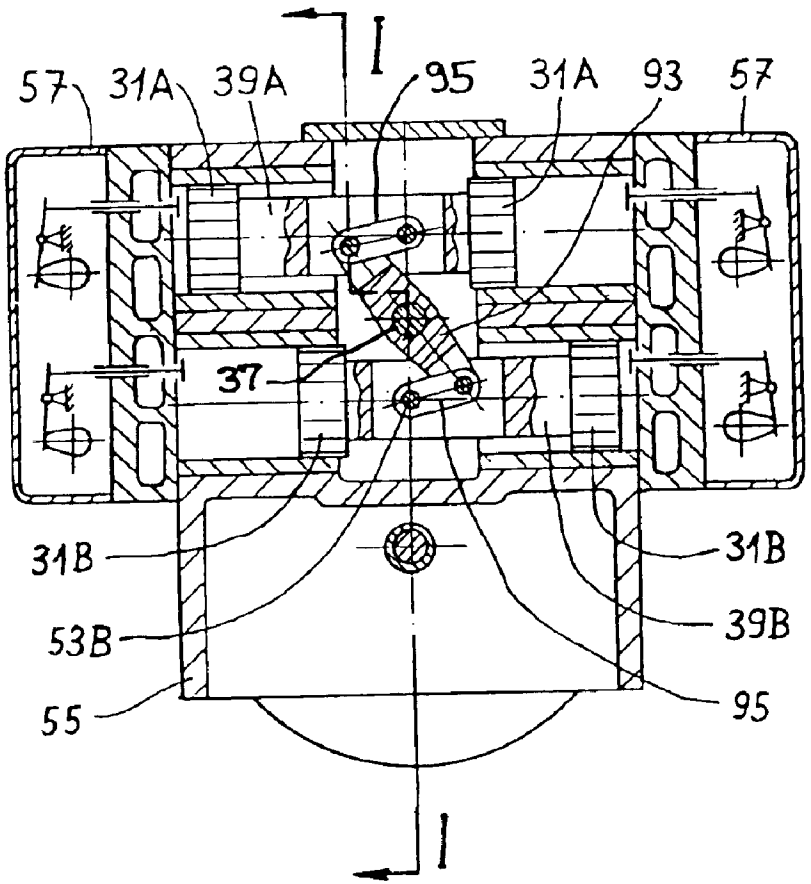
FIG. 14 shows in section a further embodiment of the invention.
Figure 16:
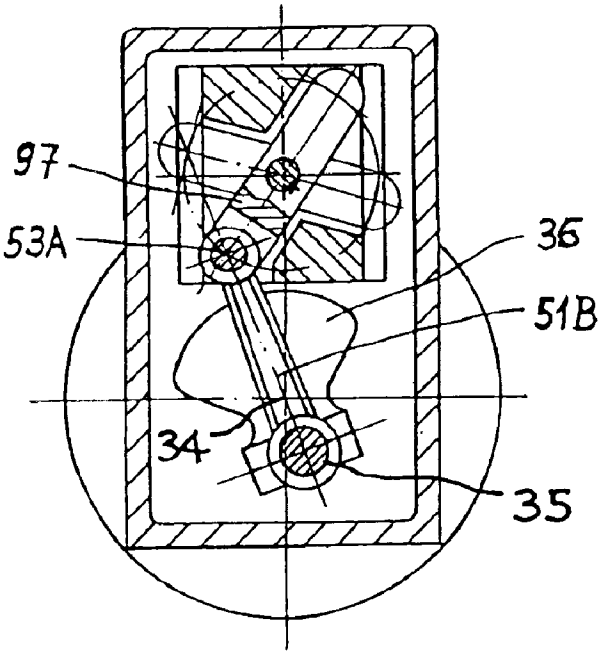
FIG. 16 is a sectional view taken on line J—J in FIG. 15.

FIGS. 14 through 16 illustrate another form that the invention can take. As shown in FIG. 14, the engine has four pistons arranged in two piston pairs. The pistons in each pair are in axial alignment, as in the arrangement depicted in FIG. 1. A rigid bar (or rod) 39A or 39B rigidly connects the aligned pistons for conjoint movement between the top dead center position and bottom dead center position.

Intermediate oscillating shaft 37 is connected to rigid bars 39A and 39B by means of two swingable links 95, 95, and a double-armed lever 93. Each link 95 has one end thereof pivotally connected to an associated bar (39A or 39B) and a second end thereof pivotally connected to lever 93. Lever 93 is affixed to shaft 37 so that linear reciprocation of pistons 31A and 31B produces a back and forth oscillation of shaft 37.

The link-lever connecting mechanism depicted in FIGS. 14 and 15 is an operable alternative to the rack-gear connection mechanism depicted in FIGS. 1, 6, 7, and 9. In each case, the connection mechanism translates linear reciprocation of the associated pistons into rotary oscillation of the intermediate shaft 37.

FIGS. 15 and 16 show a connection means for kinematically connecting shaft 97 to crankshaft 33. The connection mechanism comprises a single lever 37 carried by shaft 97 and a connecting rod 51B having a swivel connection on pin 53A that is carried by the lever. The lower end of connecting rod 51B has a swivel fit on crank pin 35. As in the previously described embodiments of the invention, crank pin 35 is offset from the crankshaft rotational axis by a distance that approximately equals the stroke travel distance of the associated pistons (31 A or 31 B), whereby the crankshaft moves one complete revolution for each reciprocation of the pistons (from top dead center to bottom dead center and back to top dead center).

The FIG. 14 engine is similar to the FIG. 1 engine, in that four pistons are used. However, the number of pistons could be increased (or doubled), as will be apparent from FIG. 6 (comparing FIG. 6 with FIG. 1). The process would involve lengthening shaft 37 and adding another bank of pistons, to achieve a square piston pattern (similar to that depicted in FIG. 6).

Figure 17:
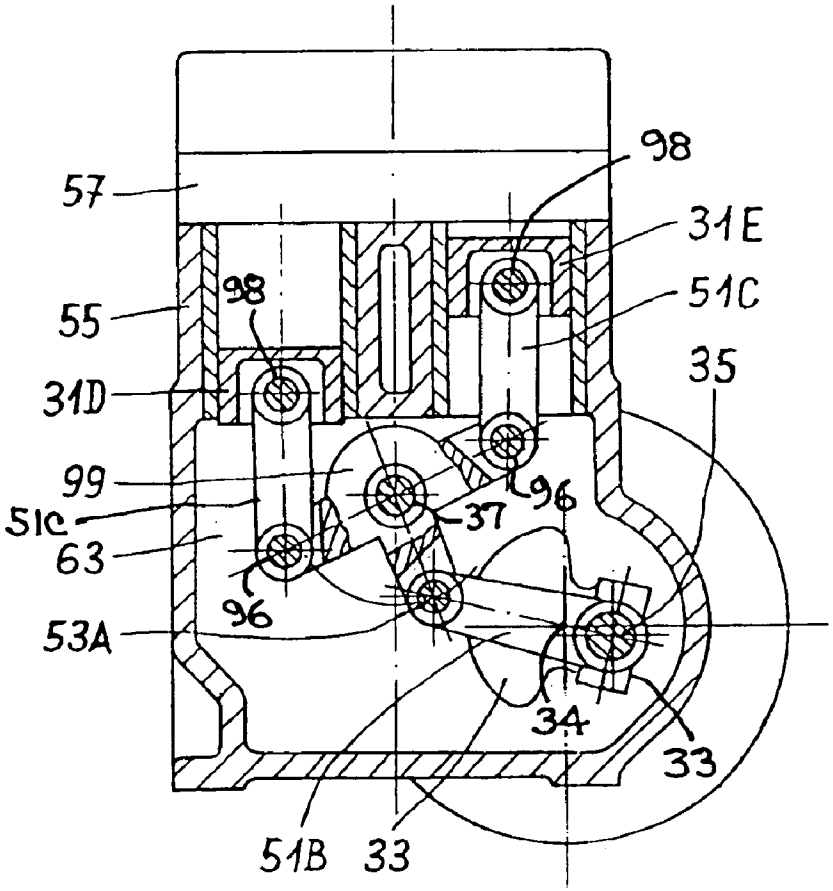
FIG. 17 is a sectional view taken through another engine embodying the Invention.

FIG. 17 shows a further form that the invention can take. As shown, the engine has two pistons 31D and 31E movable linearly on two parallel axes. Piston 31D is shown in the bottom dead center position, and piston 31E is shown in the top dead center position. The positional difference represents the piston stroke travel distance.

A link 51C extends downwardly from each piston to a three armed lever 99 that is affixed to the oscillating shaft 37. The upper end of each link 51C has a pivotal connection 98 with an associated piston. The lower end of each link 51C has a pivotal connection 96 with lever 99, whereby linear reciprocal movements of the pistons translate into rotary oscillation of shaft 37.

Lever 99 is dimensioned so that pivotal connections 96 are located approximately on the centerlines of pistons 51C during the entire piston travel, so that the load forces on the pistons are essentially axial during the entire piston travel.

The pistons exert relatively small lateral loadings on the cylinder walls, so that the pistons can be relatively short, as in the previously described embodiments of the invention.

Oscillatory shaft 37 is connected to crank pin 35 crankshaft 33 by a single connecting rod 51B. One end of the connecting rod has a pivotal connection 53A with lever 99. The other end of connecting rod 51B has a swivel fit on crank pin 35, whereby oscillatory motion of shaft 37 is translated into continuous one way rotation of crankshaft 33 around shaft axis 34.

The components are dimensioned so that pivot connections 96, 96 are a common distance from the axis of shaft 37. Also, the crank pin axis is offset from crankshaft axis 34 by approximately the same distance as the piston stroke distance, as in the previously described embodiments.

FIG. 17 shows an engine (motor) having two pistons. However, the number of pistons could be increased, as by lengthening shaft 37 and adding one or more additional pairs of pistons. An additional lever would be required on shaft 37 for each pair of additional pistons. The FIG. 17 engine design can be employed in engines having different numbers of pistons, e.g., two pistons, four pistons, six pistons or eight pistons.

It will be seen that all of the described embodiments have the common feature relating to the employment of a single intermediate oscillating shaft 37 located in the drive train so that the entire piston power output is directed through the oscillating shaft. In FIGS. 1, 6, 7, 9 and 13, the connecting means between the pistons and oscillating shaft. 37 comprises a toothed rack connected to one or more pistons, and a pinion gear carried by shaft 37. In FIGS. 14 and 17, the connecting means between the pistons and the oscillating shaft comprises a set of links connected to the pistons and a lever carried by the oscillating shaft.

Another feature common to all of described embodiments of the feature is the employment of a crankshaft having a single crank pin 35 operatively connected to to oscillating shaft 37. In FIGS. 1, 6, 7 and 9, the connecting means comprises a single sector gear 45, toothed rack 47, and connecting rod 51A. In FIGS. 16 and 17, the connecting means comprises a lever 97 and 99, and a connecting rod 51B.

A principal advantage of the invention is that the crankshaft can ba relatively low cost item, whatever the number of pistons employed in the engine. Another advantage of the invention is that the pistons experience minimal side loads, such that relatively short pistons can be employed. Engines constructed according to the invention can be relatively small and light for a given power output.

What is claimed is:

1. A reciprocating piston device comprising:

a piston-cylinder assembly having at least four cylinders and at least one case, each of said cylinders having one piston, each of said cylinder and its said piston having a common axis;

an oscillating intermediate shaft having a rotational axis, said shaft kinematically connected to said pistons;

a crankshaft having one crank and carrying an element transmitting rotation between said crankshaft and an adjacent device, said crankshaft kinematically connected to said intermediate shaft;

at least one primary transmission mechanism connecting said pistons and said intermediate shaft, each of said primary transmission mechanisms and the pistons connected to it being housed in one separate case section; and a secondary transmission mechanism connecting said intermediate shaft and said crankshaft, said secondary transmission mechanism being housed in another one separate case section having a chamber, said chamber having an opening closed by a cover.

2. The device of claim 1, wherein the piston-cylinder axes are arranged in one plane, said plane being parallel to the axis of said intermediate shaft, each said piston-cylinder piston axis having two cylinders and two pistons, said two pistons being connected by a general piston rod;

said primary transmission mechanism comprises a pinion secured on said intermediate shaft, and said general piston rod having a rack; and said secondary transmission mechanism comprises a pinion secured on said intermediate shaft, a slide block having a rack, and a connecting rod, said connecting rod being connected to said slide block on one end and to said crankshaft crank on another end.

3. The device of claim 2, further comprising at least one additional cylinder and one additional piston, said additional piston connected to its own piston rod, said additional cylinder and piston having an axis arranged on the same plane as the pistons connected by said general piston rod, each said additional piston having a primary transmission mechanism comprising a pinion secured on said intermediate shaft and said piston rod having a rack.

4. The device of claim 1, wherein the piston-cylinder axes are arranged in two planes, said planes being parallel to the axis of said intermediate shaft, each said piston-cylinder axis having two cylinders and two pistons, said two pistons being connected by a general piston rod;

said primary transmission mechanism comprises a pinion secured on said intermediate shaft and two said general piston rods, each rod having a rack; and said secondary transmission mechanism comprises a pinion secured on said intermediate shaft, a slide block having a rack, and a connecting rod, said connecting rod being connected to said slide block on one end and to said crankshaft crank on another end.

5. The device of claim 4, further comprising at least two additional cylinders and two additional pistons, said pistons connected to their own piston rods, said additional cylinders and pistons having axes arranged on the same planes as the pistons connected by said general piston rods, each two said additional pistons having a primary transmission mechanism comprising a pinion secured on said intermediate shaft and two said piston rods, each rod having a rack.

6. The device of claim 1, wherein the piston-cylinder axes are arranged in two planes, said planes being parallel to the axis of said intermediate shaft, each said piston-cylinder axis having two cylinders and two pistons, said two pistons being connected by a general piston rod;

said primary transmission mechanism comprises a double-armed lever secured on said intermediate shaft, two said general piston rods, and two shackles connecting said double-armed lever and each of said general piston rods; and said secondary transmission mechanism comprises a single-armed lever secured on said intermediate shaft, and a connecting rod, said connecting rod being connected to said single-armed lever on one end and to said crankshaft crank on another end.

7. The device of claim 1, wherein said piston-cylinder assembly comprises at least six cylinders, the axis of said cylinders are arranged in three planes, said planes being parallel to the axis of said intermediate shaft, each said piston-cylinder axis having two cylinders and two pistons, said two pistons being connected by a general piston rod, said cylinders being arranged by groups, each group having six cylinders, four of said six cylinders being arranged nearer to said intermediate shaft, and two of said cylinders being arranged farther from said shaft; and each of said group of cylinders comprises a tertiary transmission mechanism connecting two of said six cylinders arranged farther from said intermediate shaft and two cylinders arranged nearer to said shaft.

8. The device of claim 7, wherein said primary transmission mechanism comprises a pinion secured on said intermediate shaft and two said general piston rods, each said rod having a rack;

said secondary transmission mechanism comprises a pinion secured on said intermediate shaft, a slide block having a rack, and a connecting rod, said connecting rod being connected to said slide block on one end and to said crankshaft crank on another end; and said tertiary transmission mechanism comprises a pinion and two said general piston rods, each said rod having a rack.

9. The device of claim 1, wherein the axes of said cylinders are arranged in two planes, said planes being parallel to the axis of said intermediate shaft, each said piston-cylinder axis having one said cylinder and one said piston, said cylinders being arranged by groups each having two cylinders;

at least one primary transmission mechanism connecting two of said pistons and said intermediate shaft, said primary transmission mechanism having a double-armed lever secured on said intermediate shaft and two links connecting each of said pistons and said double-armed lever; and the secondary transmission mechanism connecting said intermediate shaft and said crankshaft being united with one of primary transmissions, said secondary transmission mechanism having a three-armed lever secured on said intermediate shaft, two links connecting each of said one group of pistons and one arm of said three-armed lever, and a connecting rod, said rod connecting the third arm of said three-armed lever and said crankshaft crank.

* * * * *